US010527391B1

(12) United States Patent
Moser et al.

(10) Patent No.: US 10,527,391 B1
(45) Date of Patent: Jan. 7, 2020

(54) PREPARATION OF IMPEDANCE GRADIENTS FOR COUPLING IMPULSES AND SHOCKWAVES INTO SOLIDS

(71) Applicant: The Government of the United States of America, as represented by the Secretary of the Navy, Arlington, VA (US)

(72) Inventors: Alex E. Moser, Washington, DC (US); David L. Knies, Marbury, MD (US); Kenneth S. Grabowski, Alexandria, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/892,785

(22) Filed: Feb. 9, 2018

Related U.S. Application Data

(63) Continuation-in-part of application No. 13/920,807, filed on Jun. 18, 2013, now Pat. No. 10,281,242.

(60) Provisional application No. 61/662,006, filed on Jun. 20, 2012.

(51) Int. Cl.
*F41H 5/02* (2006.01)

(52) U.S. Cl.
CPC ..... *F41H 5/02* (2013.01)

(58) Field of Classification Search
CPC ... F41H 5/00; F41H 5/013; F41H 5/02; F41H 5/023; F41H 5/04; F41H 5/0442; F41H 5/0492; F41H 7/04
USPC ..... 89/36.01–36.17
See application file for complete search history.

(56) References Cited

U.S. PATENT DOCUMENTS 3,633,520 A * 1/1972 Stiglich, Jr. ..... F41H 5/0421 109/82
3,804,034 A * 4/1974 Stiglich, Jr. ..... F41H 5/0421 428/547
4,704,943 A * 11/1987 McDougal ..... F41H 5/0428 109/80
4,876,941 A * 10/1989 Barnes ..... C04B 35/58071 89/36.02
7,332,221 B2 * 2/2008 Aghajanian ..... C04B 35/563 252/500
7,955,706 B1 * 6/2011 Withers ..... B22F 3/105 428/212
9,127,334 B2 * 9/2015 Pandey ..... C22C 1/02
(Continued)

OTHER PUBLICATIONS

Smith, J. "Application of Ultrasonics to Particle Sedimentation in Water" OSU Thesis 1961.

(Continued)

*Primary Examiner* — Stephen Johnson
*Assistant Examiner* — Benjamin S Gomberg
(74) *Attorney, Agent, or Firm* — US Naval Research Laboratory; Roy Roberts

(57) ABSTRACT

An armor system includes an armor plate, and an appliqué affixed to an exterior of the armor plate, wherein the appliqué has a density increasing in a direction towards the armor plate and configured to minimize reflection of a blast wave from the armor plate. The coupling system comprises a binder material that surrounds filler particles configured to create an impedance gradient parallel to the impulse propagation direction.

16 Claims, 21 Drawing Sheets

(56) References Cited

U.S. PATENT DOCUMENTS

| | | | | |
|---|---|---|---|---|
| 9,127,915 | B1 * | 9/2015 | Tsai | B32B 27/12 |
| 9,212,413 | B2 * | 12/2015 | Wang | B22D 19/14 |
| 2002/0058450 | A1 * | 5/2002 | Yeshurun | F41H 5/04 442/59 |
| 2006/0013977 | A1 * | 1/2006 | Duke | F41H 5/04 428/36.9 |
| 2014/0099472 | A1 * | 4/2014 | Greenhill | F42D 5/045 428/147 |

OTHER PUBLICATIONS

Kudrolli, A. "Size separation in vibrated granular matter" Rep. Prog. Phys. 67 (2004) 209-247.

* cited by examiner

PREPARATION OF IMPEDANCE GRADIENTS FOR COUPLING IMPULSES AND SHOCKWAVES INTO SOLIDS

CROSS-REFERENCE TO RELATED APPLICATIONS

This Application claims the benefit of U.S. Provisional Application No. 61/662,006 filed on Jun. 20, 2012 and U.S. application Ser. No. 13/920,807 filed on Jun. 18, 2013, each of which is incorporated herein by reference in its entirety.

BACKGROUND

In order to reduce harm to persons and property, it is desirable to mitigate high intensity impulses such as from blasts and projectiles. These impulses can arise from IEDs (Improvised Explosive Devices), mines, and the like.

BRIEF SUMMARY

In one embodiment, a method of forming an armor system includes preparing a homogenous composition comprising filler particles dispersed in a fluid binder material; casting the homogeneous composition into a mold; causing a gradient of the filler particles to form in the composition such that the composition becomes non-homogenous; hardening the binder material to trap the filler particles in the gradient, thereby forming a impedance gradient appliqué; and affixing the appliqué to an exterior of an armor plate to form an armor system, wherein the appliqué has an impedance increasing in a direction towards the armor plate.

BRIEF DESCRIPTION OF THE DRAWINGS

FIG. 4, bottom, shows a view from over structured plate. The asperities on the plate need not be pyramidal and could be conical, tetrahedral, other geometries or a combination of geometries and heights or aspect ratios

FIG. 11F shows hollow spheres (top) and solid spheres (bottom). The space between and among the spheres represents the binder.

DETAILED DESCRIPTION

Definitions

Before describing the present invention in detail, it is to be understood that the terminology used in the specification is for the purpose of describing particular embodiments, and is not necessarily intended to be limiting. Although many methods, structures and materials similar, modified, or equivalent to those described herein can be used in the practice of the present invention without undue experimentation, the preferred methods, structures and materials are described herein. In describing and claiming the present invention, the following terminology will be used in accordance with the definitions set out below.

As used in this specification and the appended claims, the singular forms "a", "an," and "the" do not preclude plural referents, unless the content clearly dictates otherwise.

As used herein, the term "and/or" includes any and all combinations of one or more of the associated listed items.

As used herein, the term "about" when used in conjunction with a stated numerical value or range denotes somewhat more or somewhat less than the stated value or range, to within a range of ±10% of that stated.

As used herein, the term "impedance" refers generally to acoustic impedance and is the product of the speed of sound in the material and the material's mass density.

DESCRIPTION

For blast mitigation, it can be shown from first principle momentum and energy conservation considerations that the minimum momentum and kinetic energy transfer occurs for a maximum inelastic collision. To accomplish this requires a structure that both maximizes energy dissipation and provides ideal coupling. Described here are appliqués to better match the impedance of the shock wave and blast products while allowing for energy dissipation. In one embodiment, the two functions (dissipation and coupling) are provided into two separate appliqués, however, it is possible to integrate the two functions into a single appliqué.

Materials Considerations for Energy Dissipation

Figure 1:
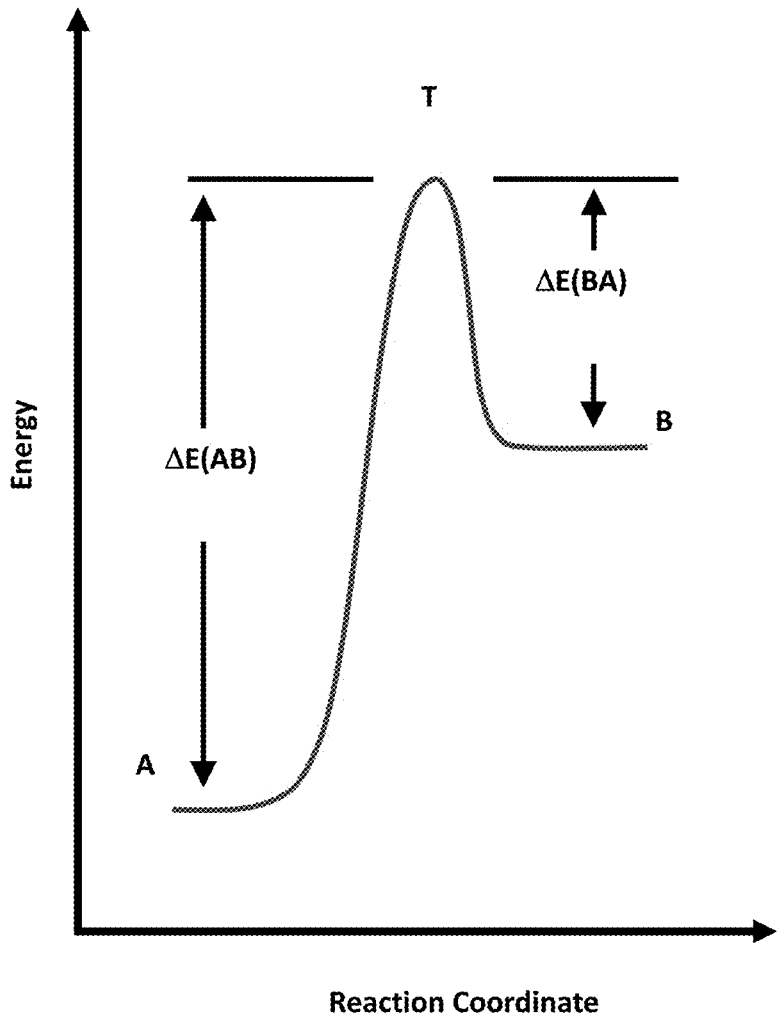
FIG. 1 illustrates the transition energy involved when a brittle material is used to mitigate a shock wave. In the case of glass, it shows the path the reaction takes from bulk glass (A) to powdered glass (B).

One example of impulse mitigation involves a brittle material, such as glass, fracturing, adsorbing energy from the impulse, and preventing the impulse energy from harming personnel and equipment (see U.S. Pat. No. 8,176,831 and US Patent Publication Nos. 2011/0203452 and 2012/0234164, each of which is incorporated herein by reference). In order for the brittle glass material within the armor system to be an effective energy absorber, it must transition through a high energy excited state associated with an activation barrier between the glass initial state and a final powdered state, as noted in Kucherov, et. al. (reference 1 below). The difference in energy between the initial and transition state, ΔE, dictates the rate, through an Arrhenius-like relationship, of the transformation from bulk to powdered glass, seen in FIG. 1.

Further, if the energy of the blast is not great enough, the transformation may not proceed and no significant energy will be absorbed by the glass. Yet, the unabsorbed energy may still be greatly detrimental to personnel behind the glass armor layer. Polymeric materials and composites have demonstrated an ability to absorb blast energy and a potential for coupling blast waves. Further, the activation barrier energy, ΔE, is lower than that found in the glass powdering process. Thus, even at lower blast energies, polymeric materials have the potential to absorb a significant portion of the blast. Also, since a plastic's ΔE is lower than that of glass, the transformation rate will be greater and the total number of finite components in the bulk polymeric material undergoing transformation will be much greater than that of glass. Thus, powdering and/or plastic deformation of polymeric materials has been demonstrated to be as, or more effective, than glass. Polymeric materials, since they are typically not as brittle as glass, are more durable and fieldable, as well. Specifically, polyvinylchloride (PVC) has been demonstrated to be a good energy absorbing material, likely due to its ability to form extended regions of irreversible plastic deformation upon exposure to a blast. Results of PVC as an energy absorbing layer during blast tests is given in Table 2 below. This specific type of PVC (Type I) may not be the optimal type for blast protection. There exist several hundred PVC formulations available on the market, so that another may prove to be better suited to this application.

Figure 2:
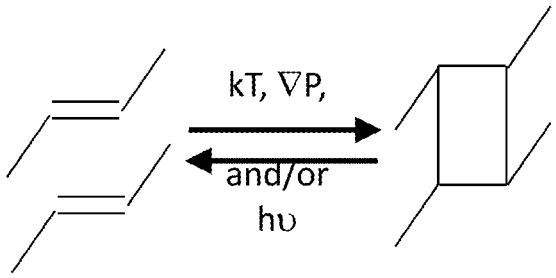
FIG. 2 illustrates a reaction schematic of a typical solid state organic reaction. Usually, the reaction requires trapping of excitons near the reaction center and the reacting centers must be in a crystalline lattice no more than 4 Å apart. However, the large pressure gradients imposed by a blast on a similar system would likely not require photo-excitation (excitonic) or a crystalline lattice.

However, other plastics may be as good as or better than PVC due to their inherent structure and solid state reaction topology at extreme pressure gradients, similar to those found in blasts. For instance, acrylonitrile butadiene styrene (ABS) may be a better energy absorber than PVC. The copolymer contains double bond groups that could react during a high pressure gradient generated by a blast. Similar types of reactions have been studied previously by Eckhardt, et.al., and others in the field of solid-state organic reactions (see references 1-3 below). Basically, the reaction scheme in solid-state organic photoreactions follow a path from two adjacent double bond moieties to a single cyclobutane ring as shown in FIG. 2.

Similarly, blast energy can be absorbed by means of a materials phase transitions including solid-solid, solid-liquid, solid-vapor, and liquid-vapor. For example, paraffin and paraffin polymer composites can be engineered to have a range of melting points tunable to optimize blast energy absorption for a specific application.

Structures for Shock Wave and Blast Product Impedance Matching

As a result of the natural laws of conservation of momentum and energy, the best possible case for energy dissipation and minimum momentum transfer occurs for a maximum inelastic collision of the shock and blast wave. This occurs when there is no reflection of the shock and blast waves, that is, the effective impedance of the armor matches that of the incoming shock and blast wave. The impedance matching layer as described herein improves shock and blast wave coupling into the armor front plate, thereby reducing the intensity of the reflected waves and minimizing kinetic energy and momentum transfer to the armor system. The energy carried by the shock and blast waves can be transformed and stored in a sacrificial layer that can react in the time it takes for the shock wave to travel across individual atomic planes, ~0.1 psec. As previously demonstrated, failure wave energy absorption by a brittle material placed behind the armor front plate can facilitate the stringent requirement.

Previous armor systems have utilized layered structures of alternating density materials to maximize coupling of the shock and blast wave to components comprising the armor system, designed to adsorb energy from the impulse. However, the previous armor systems' front surfaces have been comprised of a hard material which maximizes blast and shock wave reflection. Even an armor system having a softer front surface may produce a significant reflected blast wave due to the softer material's behavior under the extreme compressive strain rates experienced during a blast. Materials that typically display significant compliance under moderate strain rates will display low compliance under the extreme compressive strain rates experienced during a blast. The impedance matching system as described herein possesses a density gradient that minimizes or eliminates a distinguishable material boundary from which a significant reflected wave can be produced. Such a graded impedance matching system has an advantage over impedance matching layered structures because the graded system can impedance match a greater range of blast wavelengths than the layered structures. This is because the layered structures are optimized to only couple a blast wave of a specific wavelength and at a specific angle of incidence.

Analogous layered systems have been developed for optical coatings to either allow or prevent specific wavelengths of light from passing through an optical material. Another method of coupling optical wavelength into or through an optical material utilizes the concept of an optical or refractive index gradient normal to the surface through which the light is intended to pass. Such graded materials and/or surface structures have an advantage over layered optical structures because they allow a larger range of optical wavelengths to pass through the optical system.

A material system and process is proposed to maximize coupling of the shock and blast wave into an armor system's front panel, utilizing the concepts of a graded material density and structure design.

Structures of the Material System

Figure 3:
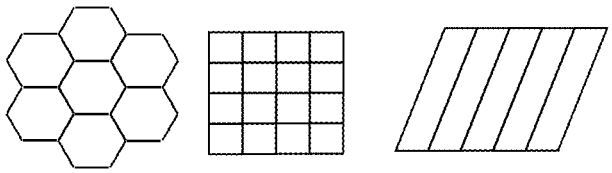
FIG. 3 schematically illustrates various configurations for channel structure. Left—Honey comb structure, Middle—square structure, Right—structure view from a side profile. The structure is tilted with respect to the channel axis, preventing a direct line-of-sight through the structure.

Impedance matching appliqués can be made from structures, for example, channels used commercially as catalytic converter support substrates, and can be used wholly or as part of a blast mitigation system. The channel structure can be mounted such that the channels are directed toward the blast origin or directed at an angle such that the back of the channel openings are obscured by the channel geometry. The channels can have any pattern including square or hexagonal—exemplary structures are shown in FIG. 3. Such channels can trap the blast wave to minimize its reflection.

In another embodiment, the coupling system comprises a binder material that surrounds filler particles configured to create an impedance gradient parallel to the impulse propagation direction. The binder may be comprised of paraffin with or without a specific n-alkane distribution, a pure metal or metal alloy, a polymer or copolymer, or polymer blend, or a variety of different configurations comprised of the aforementioned materials. In embodiments, the binder in which the particles reside may be comprised of a fluid that solidifies upon either cooling and/or chemical reaction. Examples of such fluids may include a single type or composite of the following: thermoset materials such as polyester, polyurethane, and epoxy, thermoplastic materials such as polycarbonate, nylon, and acrylic. Typical polymers have a density of approximately 1 $gm/cm^3$ with hollow spheres being less dense and the solid spheres being more dense.

The filler particles for enabling a density gradient may be comprised of hollow and/or non-hollow nano- and/or microspheres, in which the hollow is fully or partially evacuated, or filled with a solid, liquid, or gas or mixture thereof. Since bimodal particle distributions can produce a greater density, they can create a larger density gradient within a structure. The spheres may be monotonic, bi-distributed, or may have a specific particle size distribution. The spheres can be a mixture of two or more sphere types having different compositions as described above. Two different sphere types could have different densities and sizes and enable a density gradient to be formed.

Microspheres or nanospheres can be hollow (either evacuated to contain a vacuum or containing a gas) or filled with various materials. Optionally, solid particles can be coated to create filled spheres. Sphere wall materials can be, for example, silica, borosilicate, or other glassy materials, alumina or other refractory materials, amorphous metal, etc. Sphere core materials can be, for example, a gas phase material exceeding atmospheric pressure, near atmospheric pressure, or evacuated below atmospheric pressure. The sphere core material can also be, for example, a polymer solid or fluid. The spheres may be coated with a thin layer coupling layer to facilitate chemical and physical bonding to the matrix fluid material to increased strength or to impart upon the sphere an electrical charge for later processing into a gradient structure. Examples of suitable spheres include cenospheres (such as those obtained from coal ash), and similar hollow sphere systems such as 3M™ Glass Bubbles.

Figure 11A:
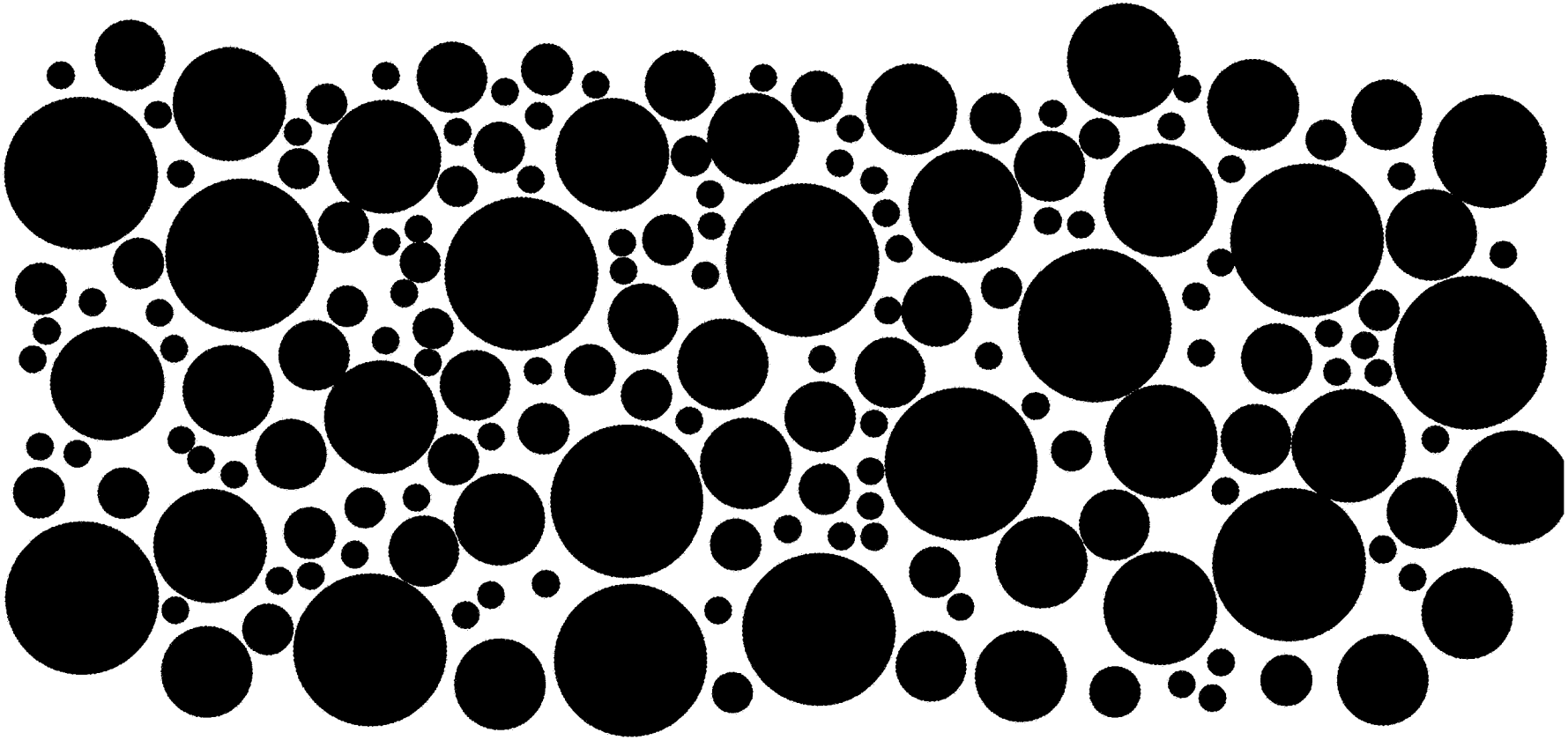
FIGS. 11A-11F schematically illustrate various particle gradient possibilities, representing views of the thickness of gradient materials before or after their preparation.
Figure 11B:
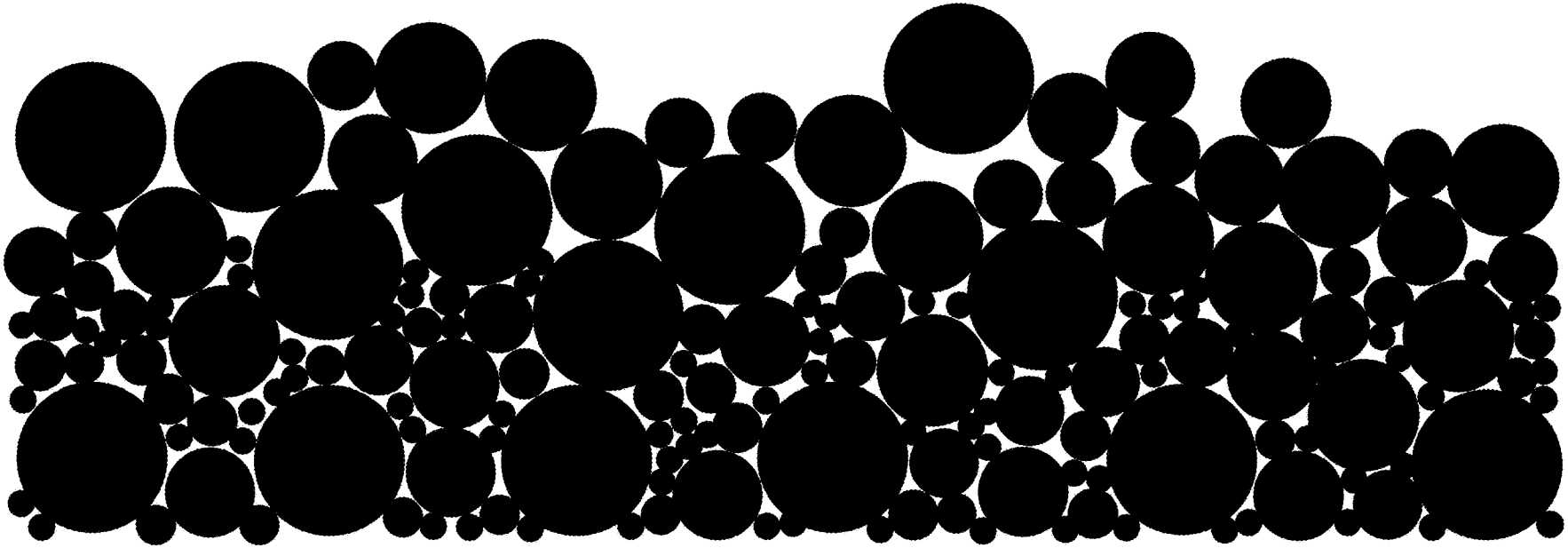
Figure 11C:
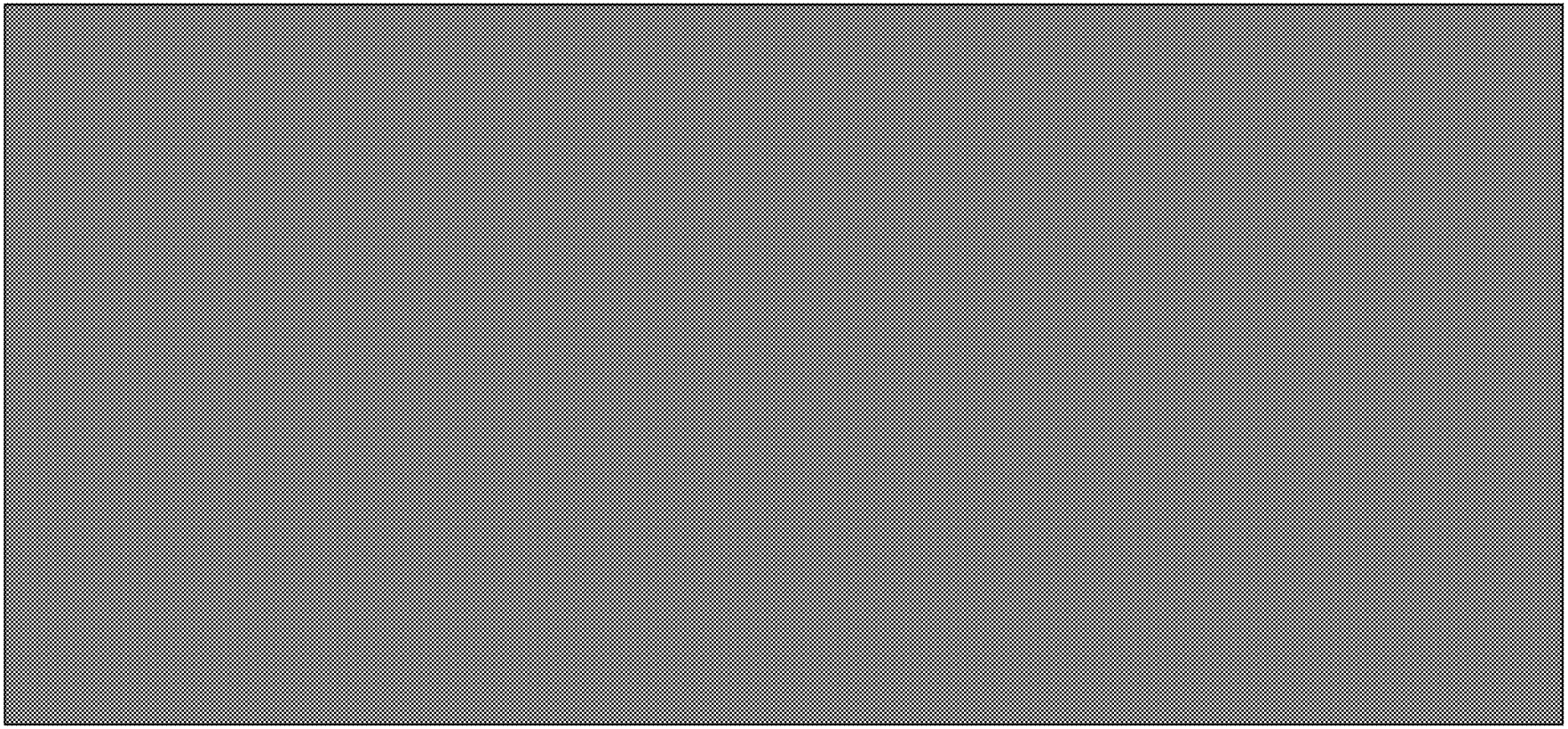
Figure 11D:
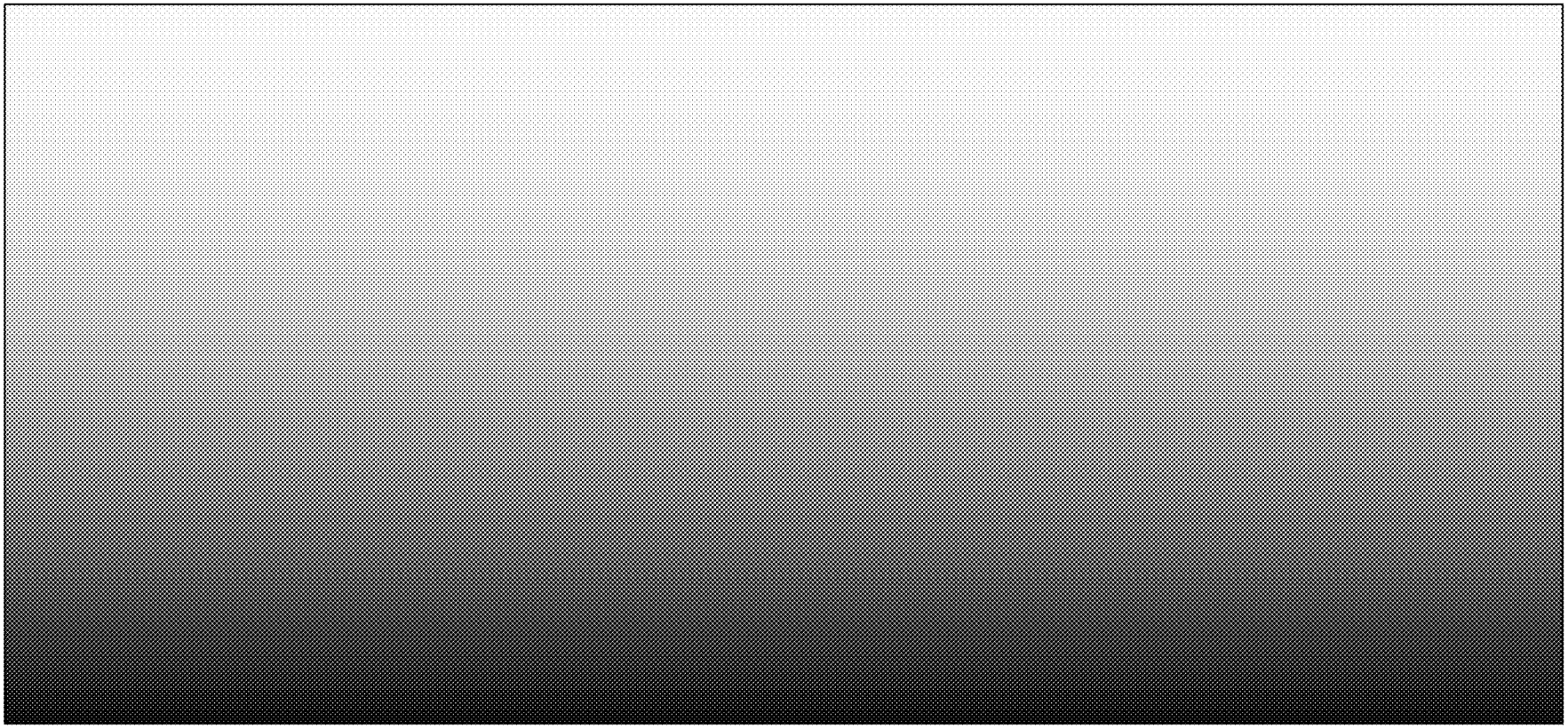

In one embodiment, the coupling structure may be made from spheres with at least a bi-modal distribution. These spheres can begin as a homogenous collection that is then packed, vibrated, and/or otherwise processed to enable the smaller spheres to settle closer to the bottom of the structure and interstitial to the larger microspheres. FIG. 11C shows a schematic example of homogeneous material in which particles are uniformly dispersed while FIG. 11D shows that same sample after settling has occurred and the more dense area/volume is at the bottom of the figure.

Further embodiments employ spheres having a range of sizes configured to couple with different wavelengths. Examples can includes spheres of sizes 5 nm to 6000 microns in which the size distribution can be single mode, bi-modal, or multi-modal with each mode within the distribution having a Gaussian, log-normal, inverse log-normal characteristic, or a combination thereof. Preferably, in embodiments where the sphere sizes are varied, the spheres have a size variation that is continuous rather than stepwise. One preferred embodiment includes a log-normal distribution of sizes.

Figure 11E:
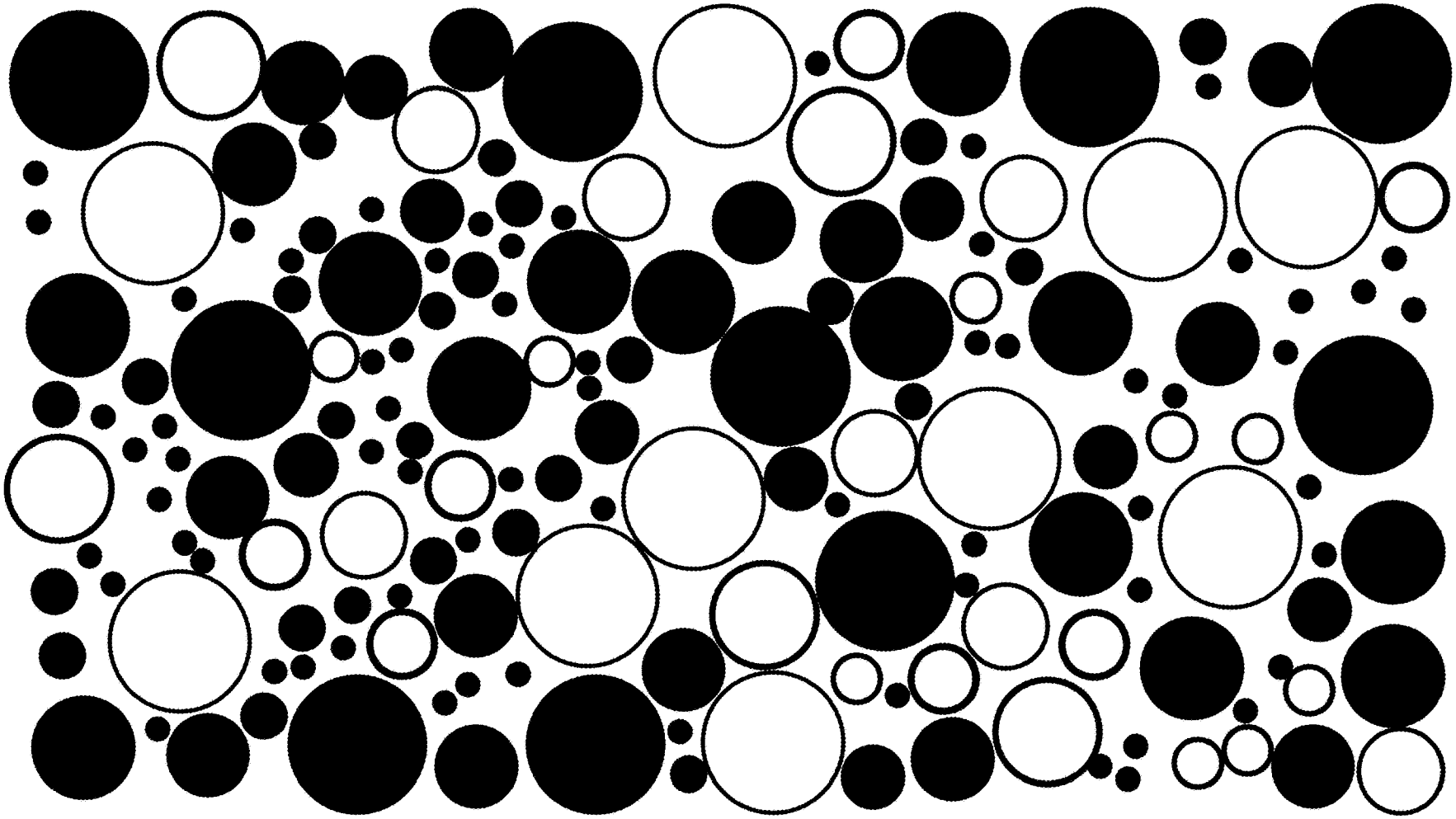
Figure 11F:
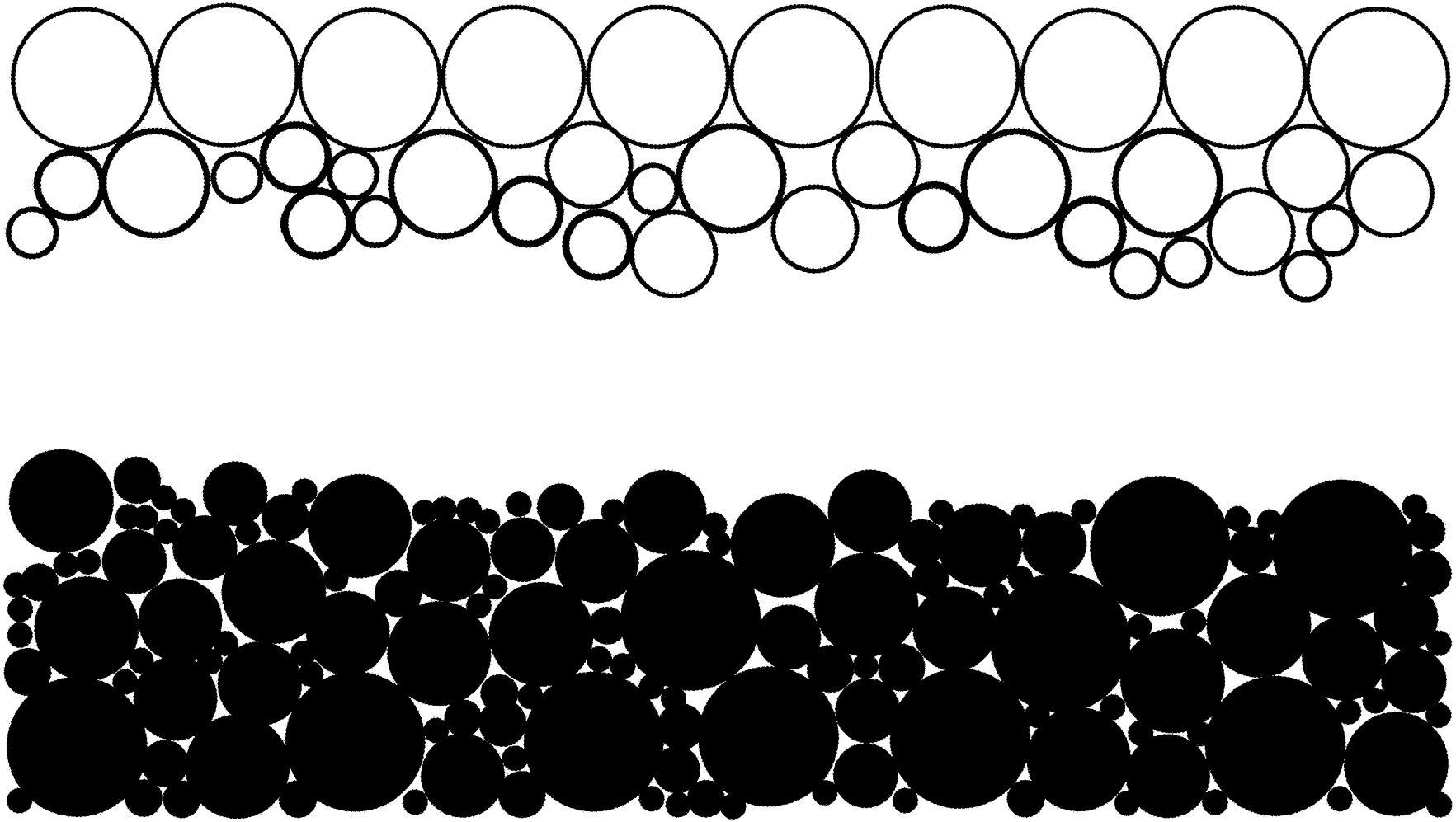

Embodiments include smaller sizes operable to fit between and fill among larger sizes. For example, FIGS. 11A and 11B illustrate a homogeneous collection of solid particles before and after gradient formation, respectively. A mixture of solid and hollow spheres can be employed, as seen in FIGS. 11E and 11F, before and after gradient formation, respectively.

Figure 4:
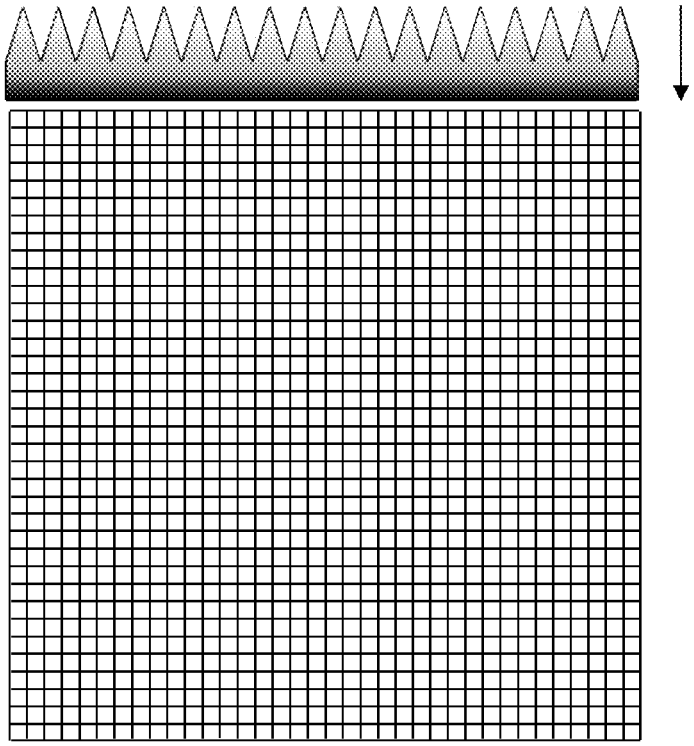
FIG. 4, top, shows a profile or cross-sectional view of density gradient plate. Density increases (dark area) toward the bottom of the plate.

In a further embodiment, shown in FIG. 4, a spire-like array structure served to couple a blast wave from air into a solid material. The coupling material was comprised of ceramic microparticles and glass microspheres in a wax binder in which the particles and microspheres produced a density gradient to reduce blast wave reflection and increase blast wave transmission into the solid material backing the wax gradient appliqué.

Blast tests were also completed using a material without a density gradient but with a spire-like structure, demonstrating the ability of these structures to couple a blast wave into a material. The structure was comprised of a 12"×12"×0.8" type 1 polyvinylchloride sheet having sharp pyramid structures (see FIG. 5). The pyramid face-apex-opposite pyramid face (PAP) angle was 30°. To obtain focusing of the blast wave as it interacts with the structure the spire face-to-face angle must be less than a specific critical angle that prevents reflection of the blast wave and is dependent of the symmetry and structure of the spire-like array.

Figure 6:
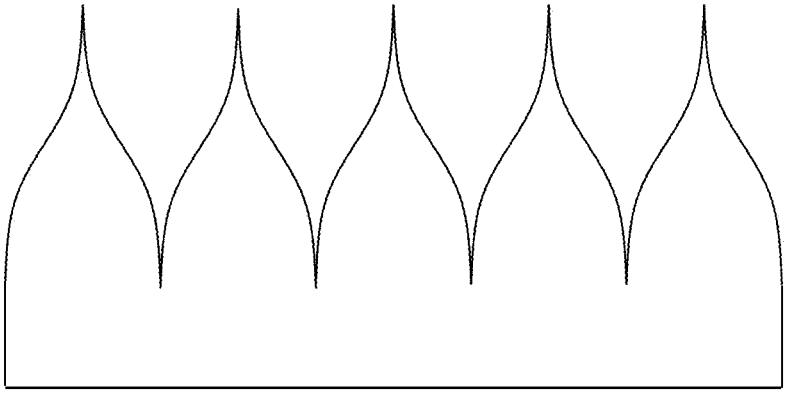
FIG. 6 shows a coupling structure that also minimizes Mach stem formation.
Figure 7:
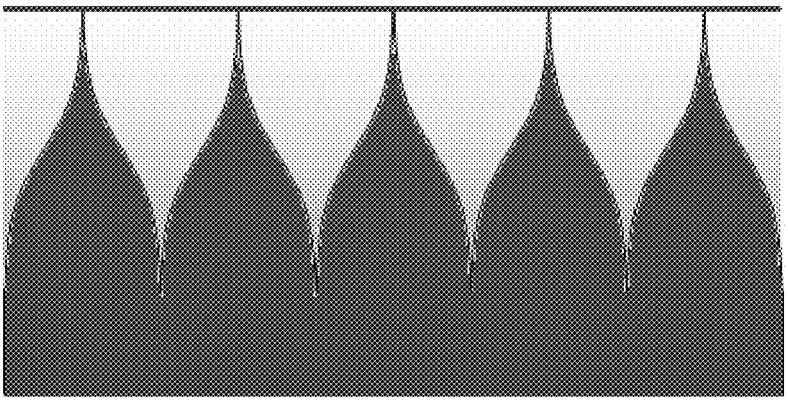
FIG. 7 shows a combined blast wave focusing (red)/density amplifying (same as FIG. 6) and density gradient (gray gradient) structure.

Ideally, the spire-like structure is made having a spire-like geometry resembling a set of tangent function (see FIG. 6). This structure will minimize Mach-stem behavior at the interface and enable better coupling of the blast wave. A combined system is also shown in FIG. 7, which optimizes coupling into the backing material.

Preparing a Density Gradient Structure

In an embodiment, the density gradient structure is made by combining the appropriate materials comprising the structure into a homogenous composition, casting the homogeneous composition into a mold and causing the density gradient to be developed by an appropriate method.

For material cast into a mold, the system can be maintained at a temperature and time adequate for diffusion of particles in the system to create a density gradient. If the temperature and temperature fluctuations in the system are adequate the particles have enough energy to rearrange such that the denser and/or smaller particles settle to the bottom while the larger and/or less dense particles migrate to the top of the casting volume.

This diffusion process can be augmented by additionally vibrating the mold or casting to impart energy into the particles to enhance the particle diffusion process within the cast fluid. Typically, ultrasonic and sonic frequencies should be adequate to achieve faster migration of the particles within the casting.

In further embodiments, gradients can be formed using electric field methods, dielectrophoresis methods, vibration and a specific sequence of vibratory steps, and/or sedimentation/gravitation. On embodiment of an electric field method utilizes two capacitive plates above and below the composite of fluid binder and filler particles at voltages ranging from 25 V to 1 MV to facilitate electrostatic migration of spheres processed to contain an electric charge. Similar charged spheres within a fluid binder composite can be made to migrate into a gradient configuration before thermosetting or reaction of the fluid binder to transform it into a solid using a similar electrical plate configuration described, but in which the electric field between the plates is oscillated using a amplitude, DC offset, frequency, and frequency distribution as a function of time to achieve the desired gradient configuration before the fluid binder material is solidified. Similarly, the mixture of spheres and fluid binder material can be vibrated using parameters such as the vibratory amplitude, frequency, and frequency distribution as a function of time to obtain the gradient configuration before the fluid binder is solidified.

To obtain a graded structure, the mold can have a structured surface mirroring that of the desired structure of the density graded material. Alternatively, blocks of the density graded material can be ground or machined to have the appropriate structure.

Application of the Density Gradient Structure

The density gradient material made from the aforementioned materials and process is applied to the front surface of armor intended to mitigate the impulse from a blast or projectile. The application can be made through mechanical bonding by direct casting onto the roughened front surface or affixing the system to the front surface using a thin epoxy or adhesive system. To accommodate a diverse set of required applications, the coupling system can be made from smaller components and tiled together on the armor system's front surface.

The aforementioned technique has undergone initial proof of concept at a certified blast test range and has shown promising results, despite use of a gradient material having unoptimized properties.

Figure 9:
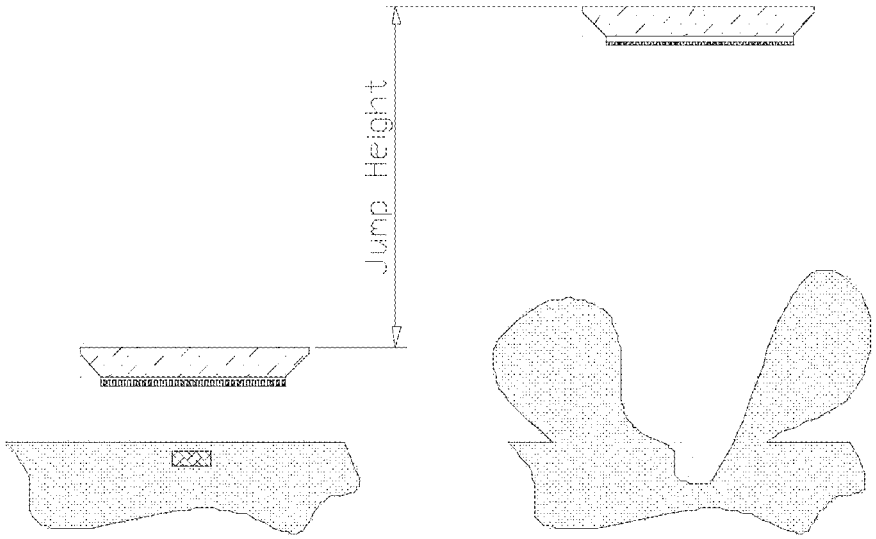
FIG. 9 shows a schematic representation of a test configuration. The armor appliqué is bolted on to the bottom of the armor system.

Jump height provides relevant and reliable data associated with blast testing (see FIG. 9) of the device under test (DUT). The jump height is used to calculate momentum and energy transfer to the DUT by assuming the DUT starts at rest, and is again at rest at the maximum jump height. At this point, all the kinetic energy imparted to the DUT by the threat is converted to potential energy.

Figure 8:
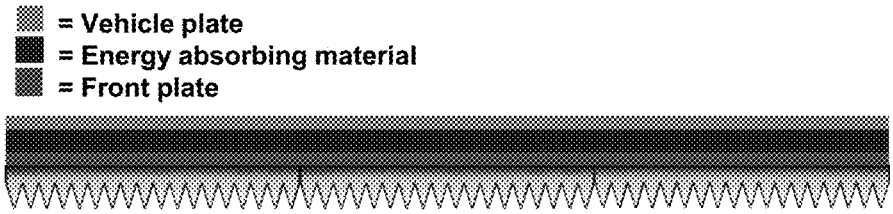
FIG. 8 schematically illustrates an exemplary impulse mitigation system. In this case, the system is designed to protect vehicle and personnel from an impulse from below, such that from an IED.

Table 1 shows a summary of some test results. Concept 3 is a construction similar to that shown in FIG. 8. The blast Impulse and energy reduction are large; 31.1% and 54.3%, respectively. Concepts 1 and 2 are variants of the most successful concept 3 system.

TABLE 1

Blast test results of blast mitigation system described herein

| Total Weight (lbs.) | Configuation | TNT (lbs.) | Jump Height (inches) | Impulse Reduction | Energy Reduction |
|---|---|---|---|---|---|
| 1050 | Reference/Control | 1.63 | 30.1 | — | — |
| 1089 | Concept 1 | 1.61 | 27.0 | 2.5% | 8.4% |
| 1050 | Concept 2 | 1.62 | 19.4 | 20.3% | 36.5% |
| 1090 | Concept 3 | 1.63 | 13.4 | 31.1% | 54.3% |
| 1050 | Reference/Control | 1.60 | 31.0 | — | — |

TABLE 2

Jump height from blast tests

| | Jump Height (inches)* | Decrease in Jump Height (%) |
|---|---|---|
| Control | 186.15 | — |
| PVC energy absorber/ impedance matching appliqué | 147.22 | 25.4 |

Blast testing of an embodiment having a cordierite channel structure demonstrated a plate jump height reduction of 30.5% compared to control, from 186.15 inches in the control to 129.31 inches.

Figure 5:
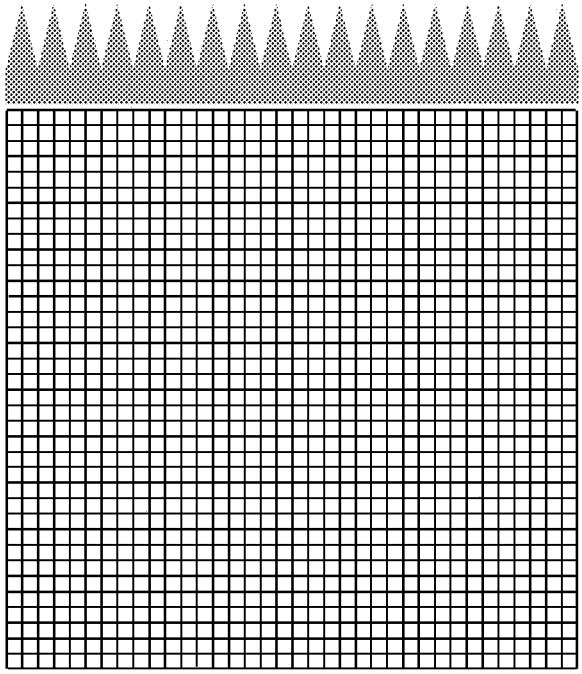
FIG. 5 shows side view (top) and direct view (bottom) of PVC spire-like array.

Blast testing of the PVC structured coupler of FIG. 5 resulted in a 27% decrease in jump height compared to a control, from 216.2 inches to 170 inches.

Further test results are show below in Table 3.

TABLE 3

Results of additional blasts test shots.

| Shot | Configuration | Location | Charge Size | Energy Reduction (%) | Impulse Reduction (%) |
|---|---|---|---|---|---|
| 5 | Solution 0 | On Ground | 1 × TNT | 0 | 0 |
| 6 | Solution 0 | On Ground | 2 × TNT | 22 | 12 |
| 10 | Solution 1 (Squares) | On Ground | 2 × TNT | 19 | 10 |
| 11 | Solution 1 (Squares) | On Ground | 2 × TNT | 19 | 10 |

TABLE 3-continued

Results of additional blasts test shots.

| Shot | Configuration | Location | Charge Size | Energy Reduction (%) | Impulse Reduction (%) |
|---|---|---|---|---|---|
| 13 | Solution 1 (Squares) | On Ground | 2 × TNT | 11 | 4 |
| 15 | Solution 1 (no Wax) | On Ground | 2 × TNT | 8 | 3 |
| 16 | Solution (PVC cubes) | On Ground | 2 × TNT | 37 | 20 |
| 17 | Solution 1 | On Ground | 2 × TNT | 54 | 31 |
| 20 | Solution 1 | Pot | 1 × C4 | 39 | 19 |
| 21 | Solution 1 | Pot | 1 × C4 | 30 | 13 |
| 24 | Solution 1 | Pot | 2 × C4 | 26 | 11 |
| 25 | Solution 1 | Pot | 2 × C4 | 17 | 6 |
| 27 | Sol. 1-C only | Pot | 2 × C4 | 4 | 1 |
| 28 | Sol. 1-EA(PVC) | Pot | 2 × C4 | 14 | 5 |
| 29 | Solution 1 | Pot | 2 × C4 | 18 | 6 |
| 30 | Sol. 1- EA only | Pot | 2 × C4 | 1 | −3 |
| 32 | Sol. 2-C (Cordierite) | Pot | 2 × C4 | 24 | 10 |
| 34 | Solution 1 | In Ground | 2 × TNT | 35 | 16 |
| 36 | Solution 1 | In Ground | 2 × TNT | 23 | 9 |
| 38 | Solution 1 | In Ground | 1 × TNT | 22 | 10 |
| 40 | Solution 1 | In Ground | 1 × TNT | 32 | 15 |
| 42 | Sol. 1-no Al | In Ground | 2 × C4 | 27 | 11 |
| 44 | Sol. 1-C(PVC) | In Ground | 2 × C4 | 16 | 5 |
| 45 | Sol. 1-EA(PVC) | In Ground | 2 × TNT | 3 | −2 |

"On Ground" means the charge was placed on a thick metal plate. "Pot" means the charge is placed in a steel pot, with the top of the charge level with ground. "In Ground" means the charge top is 1 inch below ground in water-saturated soil.

The configuration details for these additional tests were as follows.

Figure 10A:
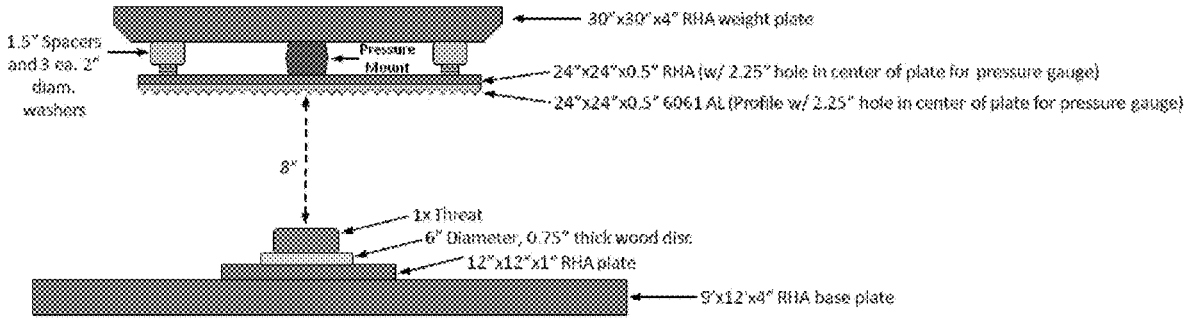
FIGS. 10A-10S illustrate various test configurations used.

Shot 5 (corresponding to FIG. 10A) target configuration (from top to bottom):

30"×30"×4" thick rolled homogeneous armor (RHA) weight 2.125" A1 Spacers (w/added washers to increase air gap to fit pressure mount)

24"×24"×0.5" thick RHA plate (w/2.25" hole in center of plate for pressure gauge)

24"×24"×0.5" thick Profile A1 plate (w/2.25" hole in center of plate for pressure gauge)

Total Target Weight: 1,050 lb.

Figure 10B:
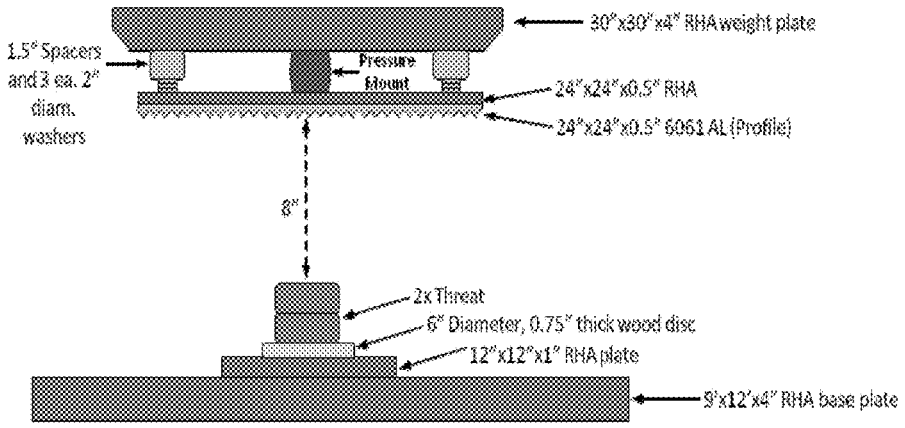

Shot 6 (corresponding to FIG. 10B) target Configuration (from top to bottom):

30"×30"×4" thick RHA Weight 2.125" A1 Spacers (w/added washers to increase air gap to fit pressure mount)

24"×24"×0.5" thick RHA plate

24"×24"×0.5" thick Profile A1 plate

Total Target Weight: 1,050 lbs

Figure 10C:
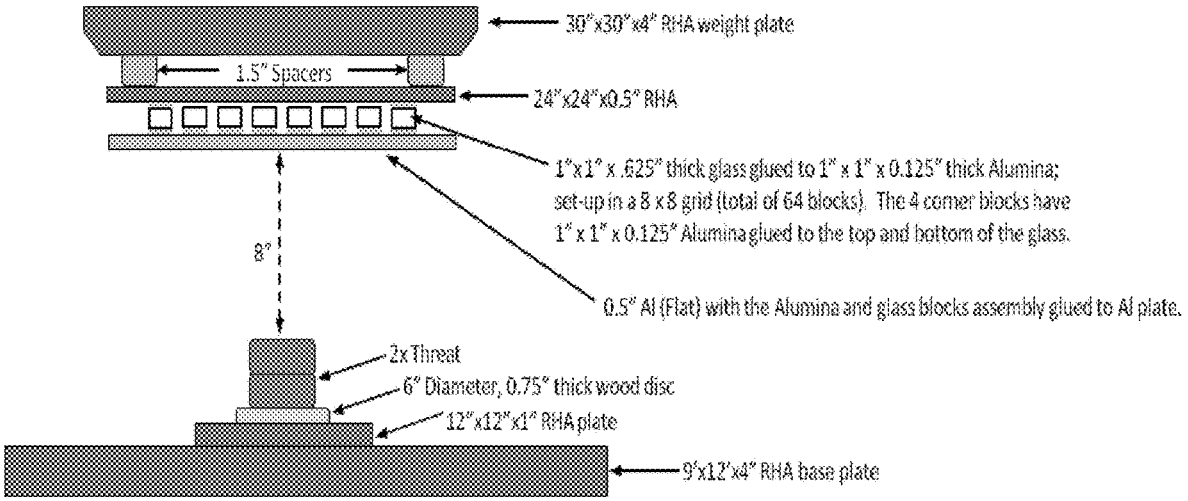

Shots 10 and 11 (corresponding to FIG. 10C):

Target Configuration (from top to bottom):

30"×30"×4" thick RHA Weight 1.5" A1 Spacers

24"×24"×0.5" thick RHA 4 ea. 1"×1"×0.125" thick Alumina 64 ea. 1"×1"×0.625" thick glass blocks 64 ea. 1"×1"×0.125" thick Alumina 24"×24"×0.5" A1 (Flat)

Total Target Weight: 1,055 lbs.

Figure 10D:
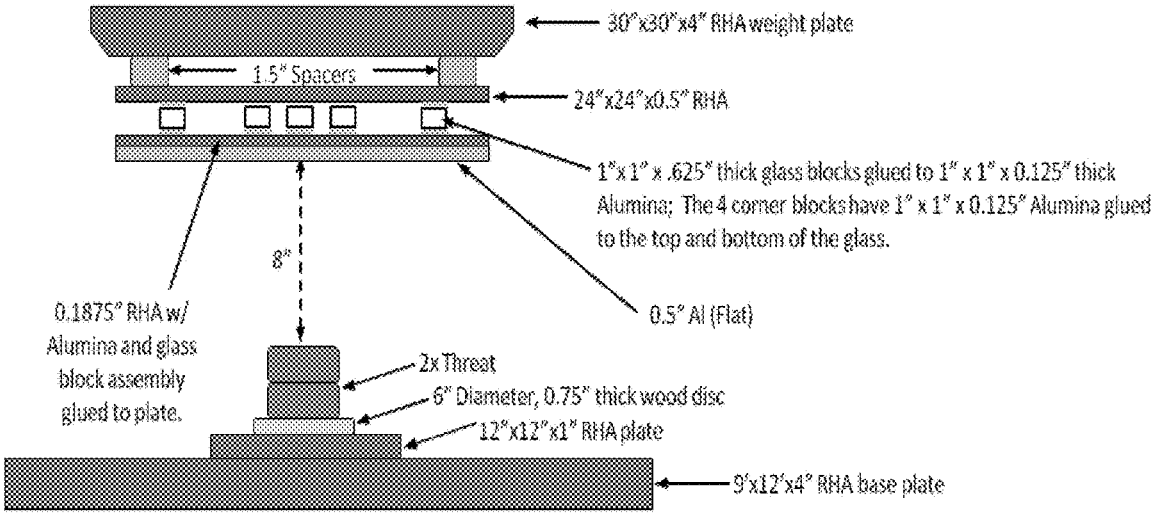

Shot 13 (corresponding to FIG. 10D):

Target Configuration (from top to bottom):

30"×30"×4" thick RHA Weight 1.5" A1 Spacers

24"×24"×0.5" RHA 4 ea. 1"×1"×0.125" thick Alumina 9 ea. 1"×1"×0.625" thick glass blocks 9 ea. 1"×1"×0.125" thick Alumina
24"×24"×0.1875" RHA
24"×24"×0.5" A1
Total Target Weight: 1,085 lbs.

Figure 10E:
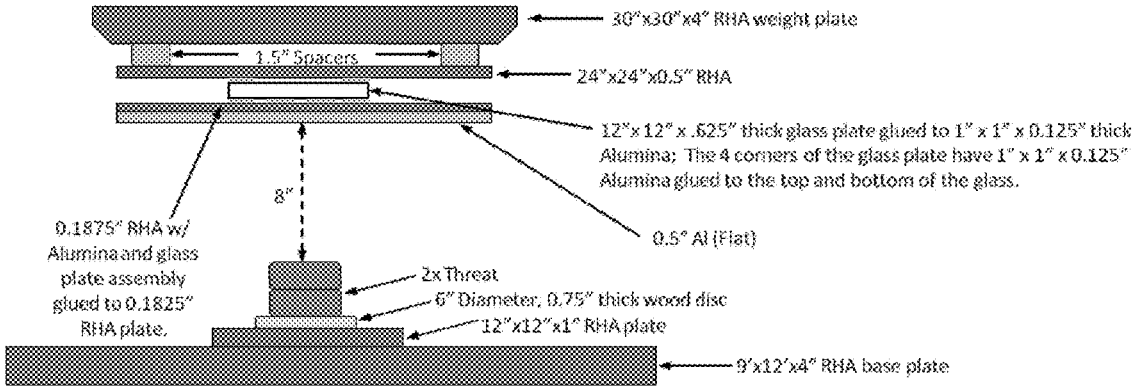

Shot 15 (corresponding to FIG. 10E):
Target Configuration (from top to bottom):
30"×30"×4" thick RHA Weight
1.5" A1 Spacers
24"×24"×0.5" RHA
4 ea. 1"×1"×0.125" Alumina
12"×12"×⅝" glass plate
17 ea. 1"×1"×0.125" Alumina
24"×24"×0.1875" RHA
24"×24"×0.5" A1
Total Target Weight: 1,089 lbs.

Figure 10F:
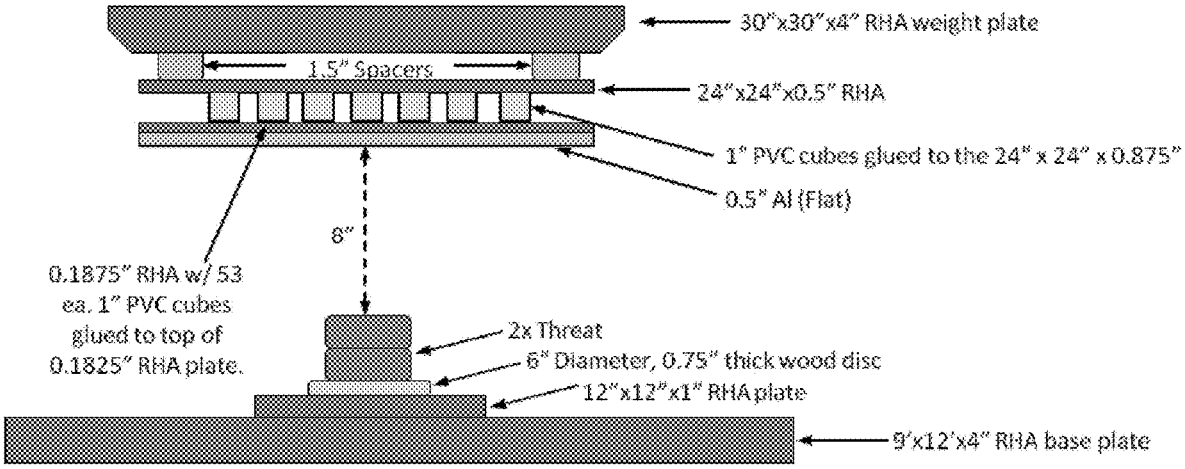

Shot 16 (corresponding to FIG. 10F):
Target Configuration (from top to bottom):
30"×30"×4" thick RHA Weight
1.5" A1 Spacers
24"×24"×0.5" RHA
53 ea—1" cube PVC
24"×24"×0.1875" RHA
24"×24"×0.5" A1
Total Target Weight: 1,050 lbs.

Figure 10G:
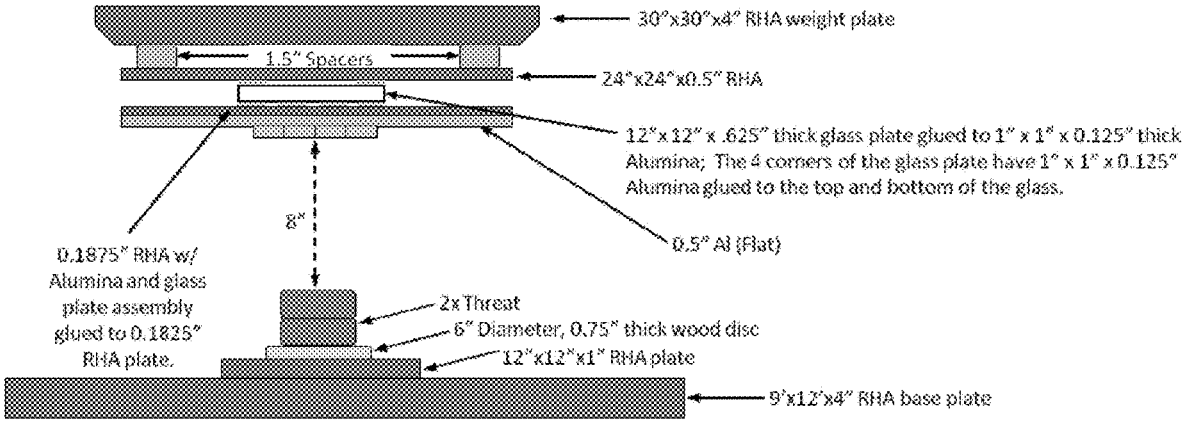

Shot 17 (corresponding to FIG. 10G):
Target Configuration (from top to bottom):
30"×30"×4" thick RHA Weight
1.5" A1 Spacers
24"×24"×0.5" RHA
4 ea. 1"×1"×0.125" Alumina
12"×12"×⅝" glass plate
17 ea. 1"×1"×0.125" Alumina
24"×24"×0.1875" RHA
24"×24"×0.5" A1
12 ea. 2"×2"×0.5" Wax w/particles (facing blast)
Total Target Weight: 1,090 lbs.

Figure 10H:
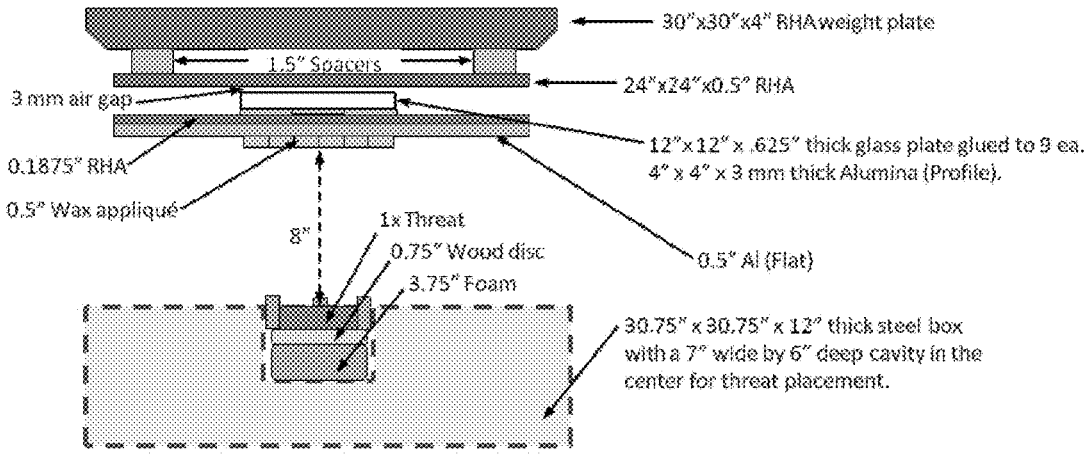

Shots 20 and 21 (corresponding to FIG. 10H):
Target Configuration (from top to bottom):
30"×30"×4" thick RHA Weight
1.5" A1 Spacers
24"×24"×0.5" RHA
3 mm air gap
12"×12"×0.625" Glass
3 mm Alumina Amplifier—Profile (9 ea. 4"×4" tiles—3×3 grid)
24"×24"×0.1875" RHA
0.5" A1
0.5" Wax appliqué (36 ea. 2"×2" tiles—6×6 grid)
Total Target Weight: 1,086 lbs.

Figure 10I:
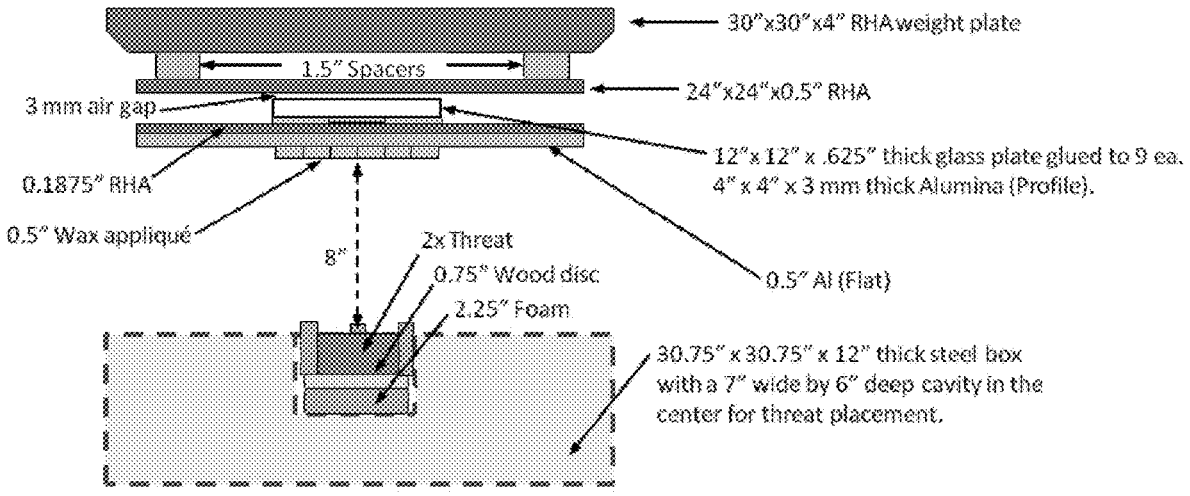

Shots 24 and 25 (corresponding to FIG. 10I):
Target Configuration (from top to bottom):
30"×30"×4" thick RHA Weight
1.5" A1 Spacers
24"×24"×0.5" RHA
3 mm air gap
12"×12"×0.625" Glass
3 mm Alumina Amplifier—Profile (9 ea. 4"×4" tiles—3×3 grid)
24"×24"×0.1875" RHA
0.5" A1
0.5" Wax appliqué (36 ea. 2"×2" tiles—6×6 grid)
Total Target Weight: 1,086 lbs.

Figure 10J:
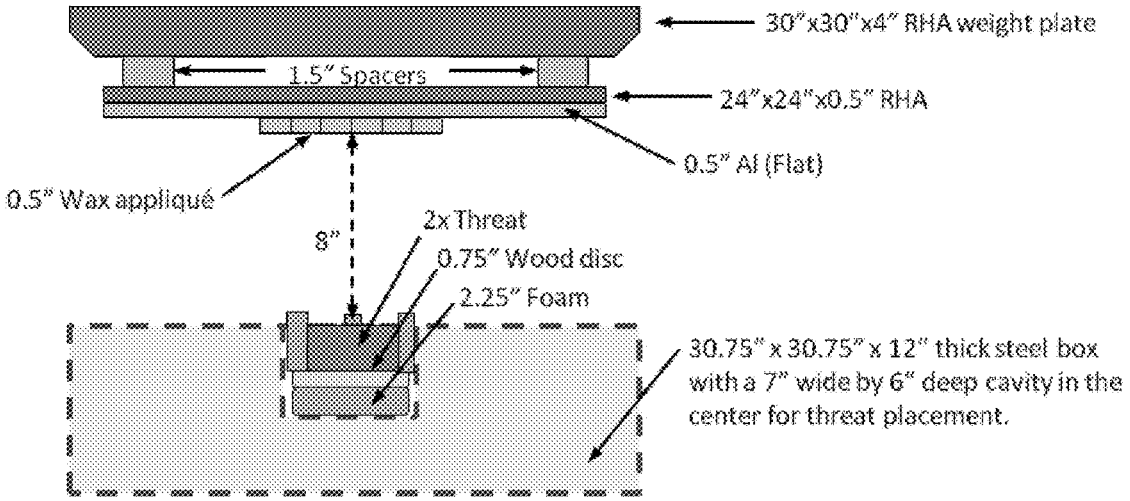

Shot 27 (corresponding to FIG. 10J):
Target Configuration (from top to bottom):
30"×30"×4" thick RHA Weight
1.5" A1 Spacers
24"×24"×0.5" RHA
0.5" A1
0.5" Wax appliqué (36 ea. 2"×2" tiles—6×6 grid)
Total Target Weight: 1,042.4 lbs.

Figure 10K:
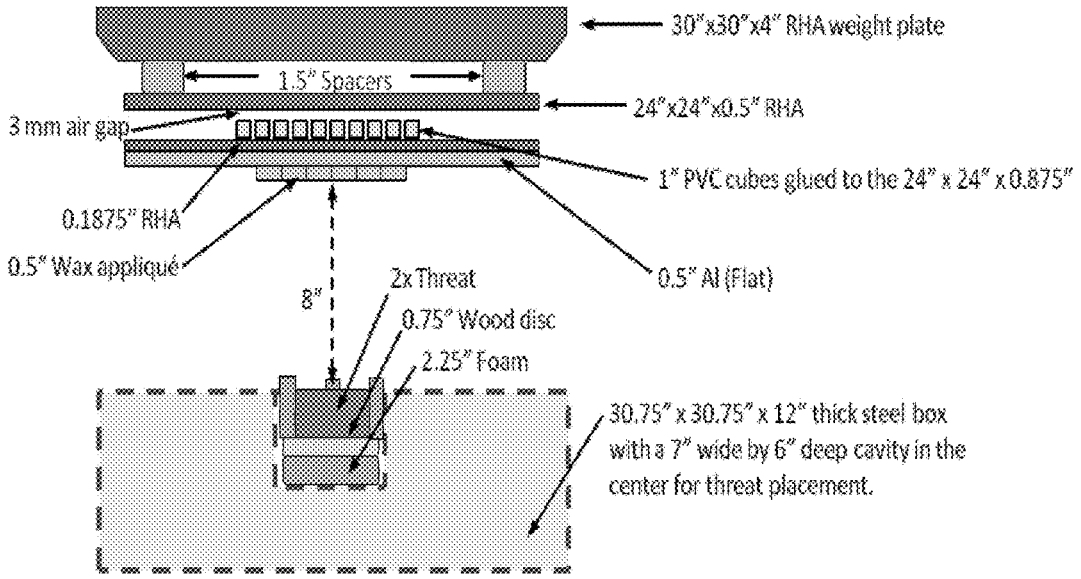

Shot 28 (corresponding to FIG. 10K):
Target Configuration (from top to bottom):
30"×30"×4" thick RHA Weight
1.5" A1 Spacers
24"×24"×0.5" RHA
3 mm air gap
100 ea. 1" PVC cubes (10×10 grid—12"×12")
24"×24"×0.1875" RHA
0.5" A1
0.5" Wax appliqué (36 ea. 2"×2" tiles—6×6 grid)
Total Target Weight: 1,078.6 lbs.

Figure 10L:
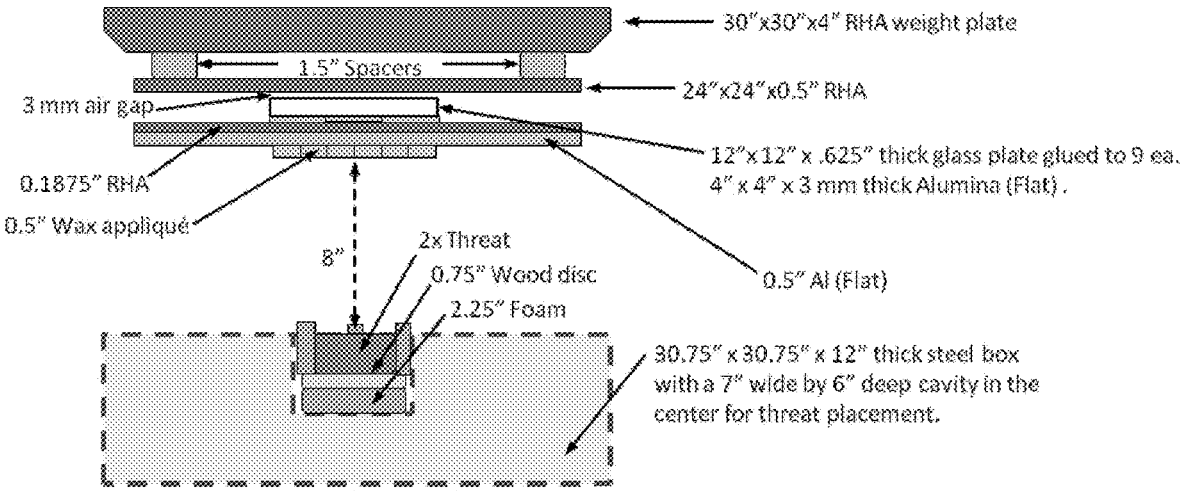

Shot 29 (corresponding to FIG. 10L):
Target Configuration (from top to bottom):
30"×30"×4" thick RHA Weight
1.5" A1 Spacers
24"×24"×0.5" RHA
3 mm air gap
12"×12"×0.625" Glass
3 mm Alumina Amplifier—Flat (9 ea. 4"×4" tiles—3×3 grid)
24"×24"×0.1875" RHA
0.5" A1
0.5" Wax appliqué (36 ea. 2"×2" tiles—6×6 grid)
Total Target Weight: 1,086 lbs.

Figure 10M:
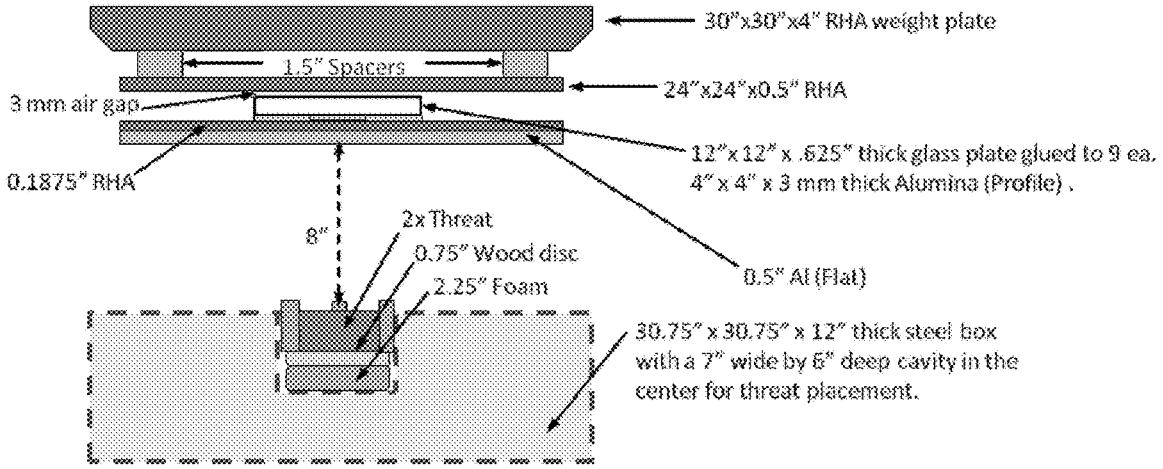

Shot 30 (corresponding to FIG. 10M):
Target Configuration (from top to bottom):
30"×30"×4" thick RHA Weight
1.5" A1 Spacers
24"×24"×0.5" RHA
3 mm air gap
12"×12"×0.625" Glass
3 mm Alumina Amplifier—Profile (9 ea. 4"×4" tiles—3×3 grid)
24"×24"×0.1875" RHA
0.5" A1
Total Target Weight: 1,083.1 lbs.

Figure 10N:
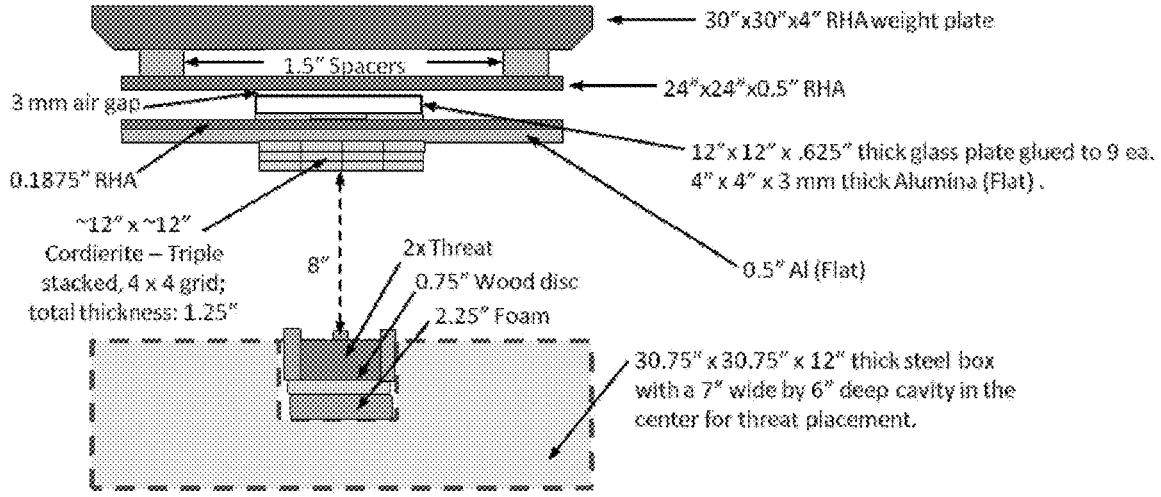

Shot 32 (corresponding to FIG. 10N):
Target Configuration (from top to bottom):
30"×30"×4" thick RHA Weight
1.5" A1 Spacers
24"×24"×0.5" RHA
3 mm air gap
12"×12"×0.625" Glass
3 mm Alumina Amplifier—Flat (9 ea. 4"×4" tiles—3×3 grid)
24"×24"×0.1875" RHA
0.5" A1
48 ea. 3"×2.5"×9 mm thick Cordierite (4×4 grid—triple stacked)
Total Target Weight: 1,087.1 lbs.

Figure 10O:
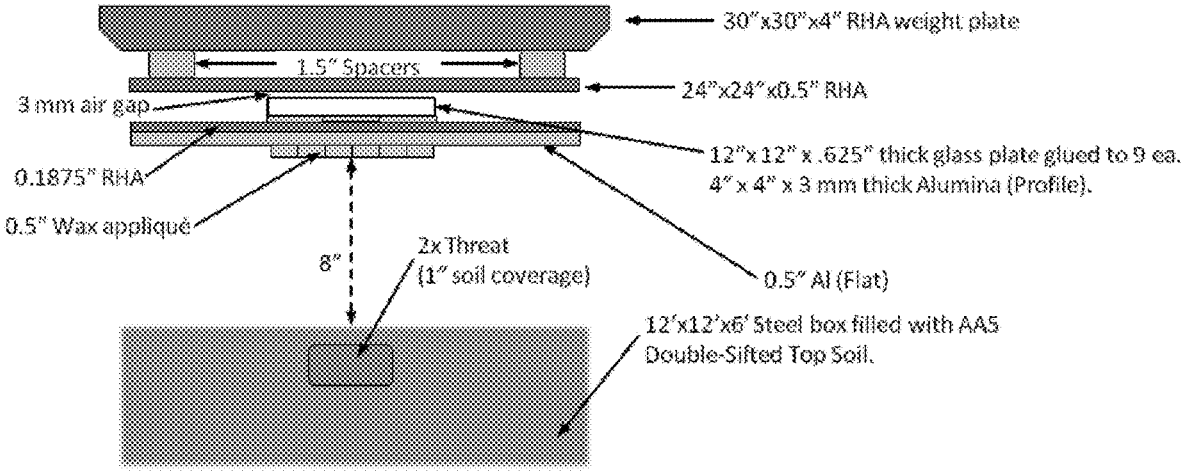

Shots 34 and 36 (corresponding to FIG. 10O):
Target Configuration (from top to bottom):
30"×30"×4" thick RHA Weight
1.5" A1 Spacers
24"×24"×0.5" RHA
3 mm air gap
12"×12"×0.625" Glass
3 mm Alumina Amplifier—Profile (9 ea. 4"×4" tiles—3×3 grid)
24"×24"×0.1875" RHA
0.5" A1
0.5" Wax appliqué (36 ea. 2"×2" tiles—6×6 grid)
Total Target Weight: 1,086 lbs.

Figure 10P:
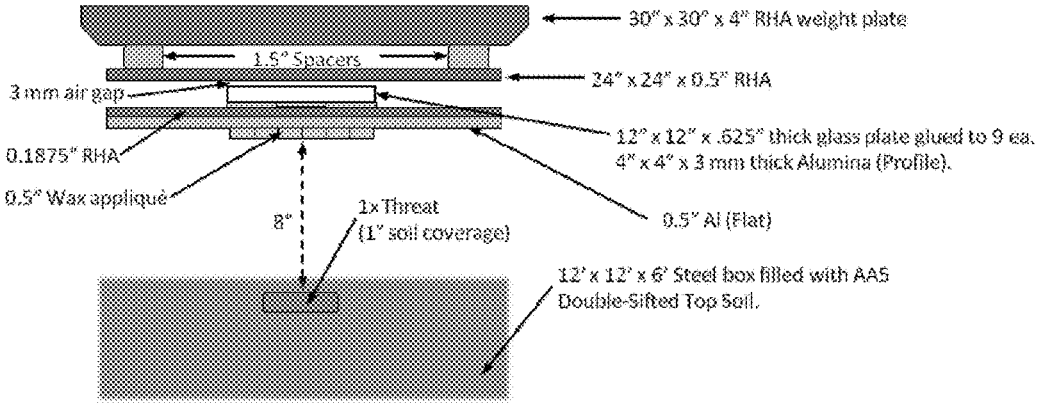

Shots 38 and 40 (corresponding to FIG. 10P):
Target Configuration (from top to bottom):
30"×30"×4" thick RHA Weight 1.5" A1 Spacers
24"×24"×0.5" RHA
3 mm air gap
12"×12"×0.625" Glass
3 mm Alumina Amplifier—Profile (9 ea. 4"×4" tiles—3×3 grid)
24"×24"×0.1875" RHA
0.5" A1
0.5" Wax appliqué (36 ea. 2"×2" tiles—6×6 grid)
Total Target Weight: 1,083.9 lbs.

Figure 10Q:
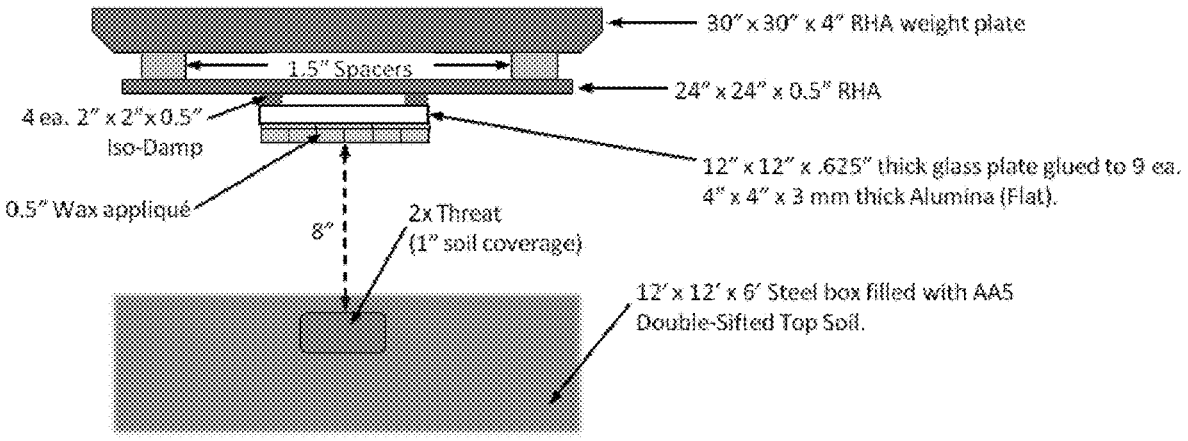

Shot 42 (corresponding to FIG. 10Q):
Target Configuration (from top to bottom):
30"×30"×4" thick RHA Weight
1.5" A1 Spacers
24"×24"×0.5" RHA
4 ea. 2"×2"×0.5" Iso-Damp (positioned in the 4 corners on top of the glass)
12"×12"×0.625" Glass
3 mm Alumina Amplifier—Flat (9 ea. 4"×4" tiles—3×3 grid)
0.5" Wax appliqué (36 ea. 2"×2" tiles—6×6 grid)
Total Target Weight: 1,086 lbs.

Figure 10R:
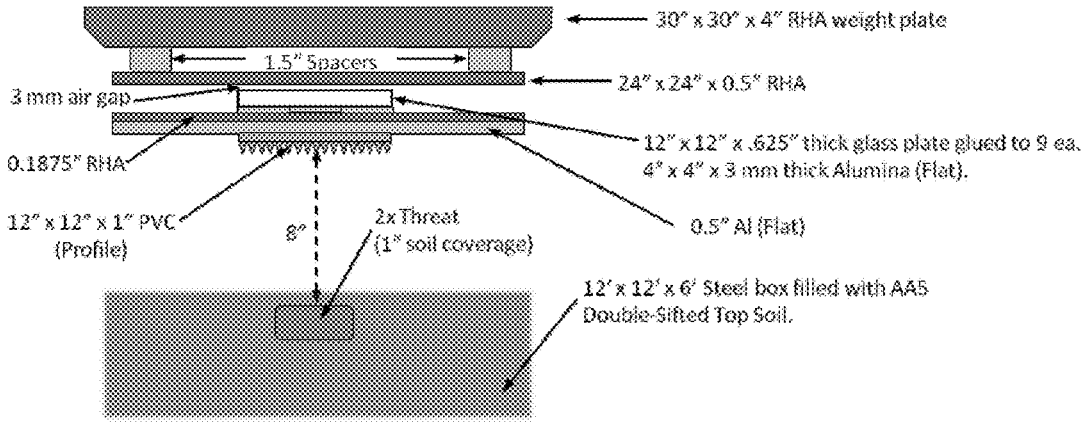

Shot 44 (corresponding to FIG. 10R):
Target Configuration (from top to bottom):
30"×30"×4" thick RHA Weight
1.5" A1 Spacers
24"×24"×0.5" RHA
3 mm air gap
12"×12"×0.625" Glass
3 mm Alumina Amplifier—Flat (9 ea. 4"×4" tiles—3×3 grid)
24"×24"×0.1875" RHA
0.5" A1
12"×12"×1" PVC (Profile)
Total Target Weight: 1,085.7 lbs.

Figure 10S:
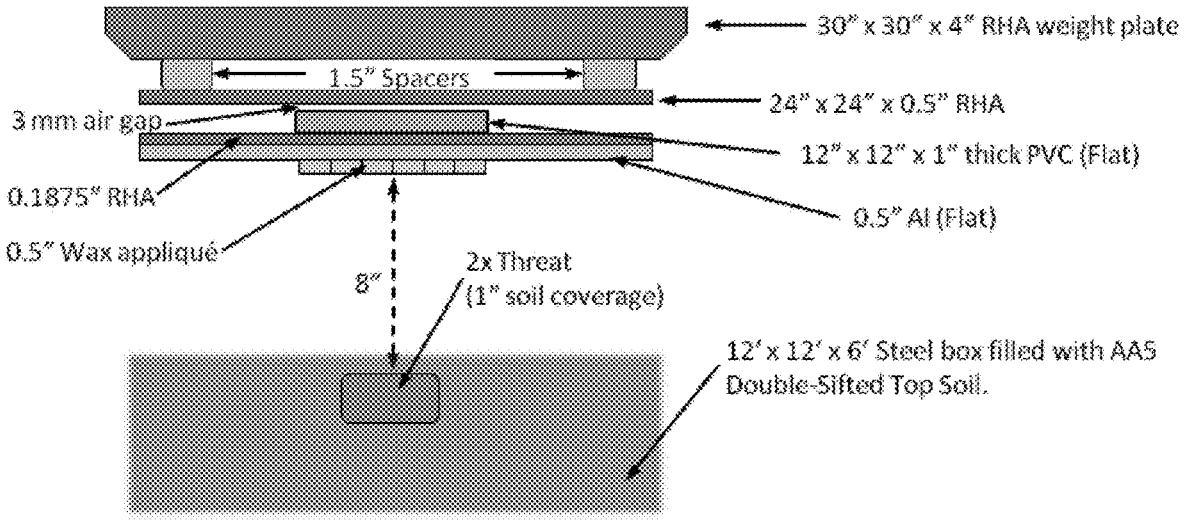

Shot 45 (corresponding to FIG. 10S):
Target Configuration (from top to bottom):
30"×30"×4" thick RHA Weight
1.5" A1 Spacers
24"×24"×0.5" RHA
3 mm air gap
12"×12"×1" PVC (Flat)
24"×24"×0.1875" RHA
0.5" A1
0.5" Wax appliqué (36 ea. 2"×2" tiles—6×6 grid)
Total Target Weight: 1,084.8 lbs.

All documents mentioned herein are hereby incorporated by reference for the purpose of disclosing and describing the particular materials and methodologies for which the document was cited.

Although the present invention has been described in connection with preferred embodiments thereof, it will be appreciated by those skilled in the art that additions, deletions, modifications, and substitutions not specifically described may be made without departing from the spirit and scope of the invention. Terminology used herein should not be construed as being "means-plus-function" language unless the term "means" is expressly used in association therewith.

REFERENCES

Each of the following is incorporated by reference herein in its entirety (1) Acoustic waves excited by phonon decay govern the fracture of brittle materials, Yan Kucherov, Graham Hubler, John Michopoulos, and Brant Johnson *J. Appl. Phys.* 111, 023514 (2012).

(2) Energetics of organic solid-state reactions: the topochemical principle and the mechanism of the oligomerization of the 2,5-distyrylpyrazine molecular crystal, N. M. Peachey and C. J. Eckhardt, *Journal of the American Chemical Society* 1993 115 (9), 3519-3526.

(3) General Theoretical Concepts for Solid State Reactions: Quantitative Formulation of the Reaction Cavity, Steric Compression, and Reaction-Induced Stress Using an Elastic Multipole Representation of Chemical Pressure, Tadeusz Luty and Craig J. Eckhardt, *Journal of the American Chemical Society* 1995 117 (9), 2441-2452.

What is claimed is:

1. A method of forming an armor system, the method comprising:

preparing a homogeneous composition comprising filler particles dispersed in a fluid binder material;

casting the homogeneous composition into a mold;

causing a gradient of the filler particles to form in the composition such that the composition becomes non-homogeneous;

hardening the binder material to trap the filler particles in the gradient, thereby forming an impedance gradient appliqué; and affixing the appliqué to an exterior of an armor plate, wherein the appliqué has an impedance increasing in a direction towards the armor plate.

2. The method of claim 1, wherein, during the causing step, settling is used in order to form the gradient of the filler particles.

3. The method of claim 1, wherein, during the causing step, said mold is subjected to vibration effective to encourage formation of the gradient of the filler particles.

4. The method of claim 1, wherein, during the causing step, an electric field is applied to the composition, thereby encouraging formation of the gradient of the filler particles.

5. The method of claim 1, further comprising grinding and/or machining said impedance gradient appliqué to form sharply-pointed spires.

6. The method of claim 5, wherein said sharply-pointed spires are exposed to air after the grinding and/or machining step.

7. The method of claim 1, wherein the binder material is hardened by cooling or by chemical reaction during the hardening step.

8. The method of claim 1, wherein the binder material is a polymeric energy absorbing material.

9. The method of claim 8, wherein said polymeric energy absorbing material is selected from the group consisting of polyvinylchloride and acrylonitrile butadiene styrene.

10. The method of claim 1, wherein said filler particles comprise nano- and/or micro-spheres.

11. The method of claim 10, wherein the spheres are hollow and in which the hollow is fully or partially evacuated, or filled with a solid, a liquid, a gas, or a mixture thereof.

12. The method of claim 1, wherein said filler particles have a bimodal size distribution.

13. The method of claim 1, wherein said filler particles have a log-normal distribution of sizes.

14. The method of claim 1, wherein the step of affixing the appliqué comprises direct casting, epoxy, adhesive, bolts, or a combination thereof.

15. A method of forming an armor system, the method comprising:

preparing a homogeneous composition comprising filler particles dispersed in a fluid binder material;

casting the homogeneous composition into a mold;

causing a gradient of the filler particles to form in the composition such that the composition becomes non-homogeneous;

hardening the binder material to trap the filler particles in the gradient, thereby forming an impedance gradient appliqué; and affixing the appliqué to an exterior of an armor plate, wherein the appliqué has an impedance increasing in a direction towards the armor plate, wherein said filler particles comprise a first population of particles having a density greater than that of the binder material and a second population of particles having a density lower than that of the binder material.

16. A method of forming an armor system, the method comprising:

preparing a homogeneous composition comprising filler particles dispersed in a fluid binder material, the filler particles having a log-normal distribution of sizes;

casting the homogeneous composition into a mold;

applying an electric field to the homogeneous composition to cause a gradient of the filler particles to form in the composition such that the composition becomes non-homogeneous;

hardening the binder material to trap the filler particles in the gradient, thereby forming a solid impedance gradient appliqué; and affixing the appliqué to an exterior of an armor plate, wherein the appliqué has an impedance increasing in a direction towards the armor plate.

* * * * *